US005132199A

United States Patent [19]

Takaoka et al.

[11] Patent Number: 5,132,199

[45] Date of Patent: Jul. 21, 1992

[54] ELECTROPHOTOGRAPHIC IMAGE-FORMING METHOD

[75] Inventors: Kazuhito Takaoka, Kadoma; Uehara Masatoshi, Hirakata; Yumiko Sano, Ibaraki, all of Japan

[73] Assignee: Mita Industrial Co., Ltd., Osaka, Japan

[21] Appl. No.: 558,239

[22] Filed: Jul. 26, 1990

[30] Foreign Application Priority Data

Jul. 31, 1989 [JP] Japan ..... 1-198522

[51] Int. Cl.[5] ..... G03G 13/14

[52] U.S. Cl. ..... 430/126

[58] Field of Search ..... 430/126

[56] References Cited

U.S. PATENT DOCUMENTS 2,924,519 2/1960 Bertelsen ..... 430/126

3,932,035 1/1976 Sato et al. ..... 430/126

*Primary Examiner*—John Goodrow

*Attorney, Agent, or Firm*—Wenderoth, Lind & Ponack

[57] ABSTRACT

An image-forming method including the steps of forming a thin layer of a photosensitive toner charged to have a given polarity on a conductive drum, exposing the thin layer to light according to image information, and transferring a part of the photosensitive toner onto a transfer material. The transferring step includes contacting the transfer material with the thin layer after the exposing step as applying a pressure to the transfer material, and irradiating a corona ion from a back side of the transfer material to the thin layer by using a corona charger. Thus, the transfer material is maintained in pressure contact with the thin layer of the toner during the transferring step, thereby improving a transfer efficiency of the toner to the transfer material to obtain a satisfactory image having a high density and no void.

3 Claims, 6 Drawing Sheets

ELECTROPHOTOGRAPHIC IMAGE-FORMING METHOD

FIELD OF THE INVENTION

The present invention relates to an improved electrophotographic image-forming method for forming an image by exposing a thin layer comprised of photosensitive toner to light to form an electrostatic latent image on the thin layer, and transferring the toner after exposed onto a transfer material. More particularly, the present invention relates to said image-forming method which provides a remarkable improvement in transfer efficiency.

BACKGROUND OF THE INVENTION

Conventionally, an image-forming method using a so-called photosensitive toner functioning as both a developer and a photoconductor is known. In such a known method, a thin layer of the toner having a photoconductivity is formed on a conductive drum, and the toner thin layer is then exposed to light to obtain a toner image.

FIG. 2 shows an example of the prior art image-forming method. Referring to FIG. 2, a toner thin layer 23 of a photosensitive toner 22 charged to have a given polarity by triboelectric charging or the like is formed on a toner retaining member 21 having a conductivity (the photosensitive toner 22 may be charged to have a given polarity by corona charging or the like after forming the toner thin layer). Then, exposure 24 according to an original image is applied to the toner thin layer 23. Accordingly, the toner is made conductive by the exposure 24, and the charge possessed by the toner is dissipated through the conductive toner retaining member 21 which is grounded, or a charge having a reverse polarity is injected into the toner. Thus, an electrostatic latent image 25 is formed on the toner thin layer. On the other hand, a transfer material 26 is brought into contact with the toner thin layer on which the latent image 25 has been formed, and a corona ion is irradiated from a back side of the transfer material 26 by means of a transfer charger 27. As a result, the transfer material 26 is charged to have a polarity reversed to or the same as that of the toner not exposed, thereby transferring the toner onto the transfer material 26. In the former case where the transfer material is charged to have the reversed polarity, a positive image is formed, while in the latter case where the transfer material is charged to have the same polarity, a negative image is formed.

However, the above-mentioned transfer step is different from a general transfer process for transferring a toner image only formed on a photosensitive body in a xerography system which is represented by a Carlson process. That is, the transfer step as shown in FIG. 2 includes contacting of the transfer material with the toner thin layer and separating of the toner (toner image) having a given polarity only from the toner thin layer. Generally, the adherence between the toner and the transfer material is lacking, and it is accordingly difficult to sufficiently contact the transfer material with the toner thin layer, thus making an improvement in transfer efficiency difficult.

In the xerography system as mentioned above wherein a toner image only to be transferred is formed on the photosensitive body, there has been proposed that a presser means for pressing the transfer material is provided on an upstream side of a transfer region into which the transfer material is introduced or on a downstream side of the transfer region from which the transfer material is discharged, so as to improve the contact between the transfer material and the toner on the toner retaining member (e.g., a photosensitive drum). However, since the adherence between the transfer material and the toner is low, the presser means as mentioned above cannot yet provide a sufficient contact between the transfer material and the toner thin layer (toner image) at an opening portion of the transfer charger located at the transfer region. Therefore, the image density cannot be increased.

SUMMARY OF THE INVENTION

It is an object of the present invention to provide an improved electrophotographic image-forming method which can eliminate the above-mentioned problem in the conventional electrophotographic image-forming method, and can form a toner image having a desired high density steadily and stably.

According to the present invention, there is provided an image-forming method comprising the steps of forming a thin layer of a photosensitive toner charged to have a given polarity on a conductive drum, exposing said thin layer to light according to image information, and transferring a part of said photosensitive toner onto a transfer material, said transferring step comprising contacting said transfer material with said thin layer after said exposing step while applying a pressure to said transfer material, and irradiating a corona ion from a back side of said transfer material to said thin layer by using a corona charger.

The feature of the present invention is that a presser member for pressing the transfer material against the toner thin layer is provided at the opening portion of the transfer charger.

According to the present invention, the presser member for maintaining the transfer material in pressure contact with the toner thin layer is provided at the opening region of the transfer charger where the corona ion is irradiated to carry out an actual transfer operation. With this arrangement, the contact between the toner thin layer and the transfer material can be maintained sufficient during the transfer operation, resulting in remarkable improvement in transfer efficiency.

Other objects and features of the invention will be more fully understood from the following detailed description and appended claims when taken with the accompanying drawings.

DETAILED DESCRIPTION AND THE PREFERRED EMBODIMENTS OF THE INVENTION

The electrophotographic image-forming method of the present invention is embodied by using a suitable electrophotographic image-forming system for forming an image by forming an electrostatic latent image with use of a photosensitive toner and transferring the latent image onto a transfer material such as a sheet of paper.

Figure 4:
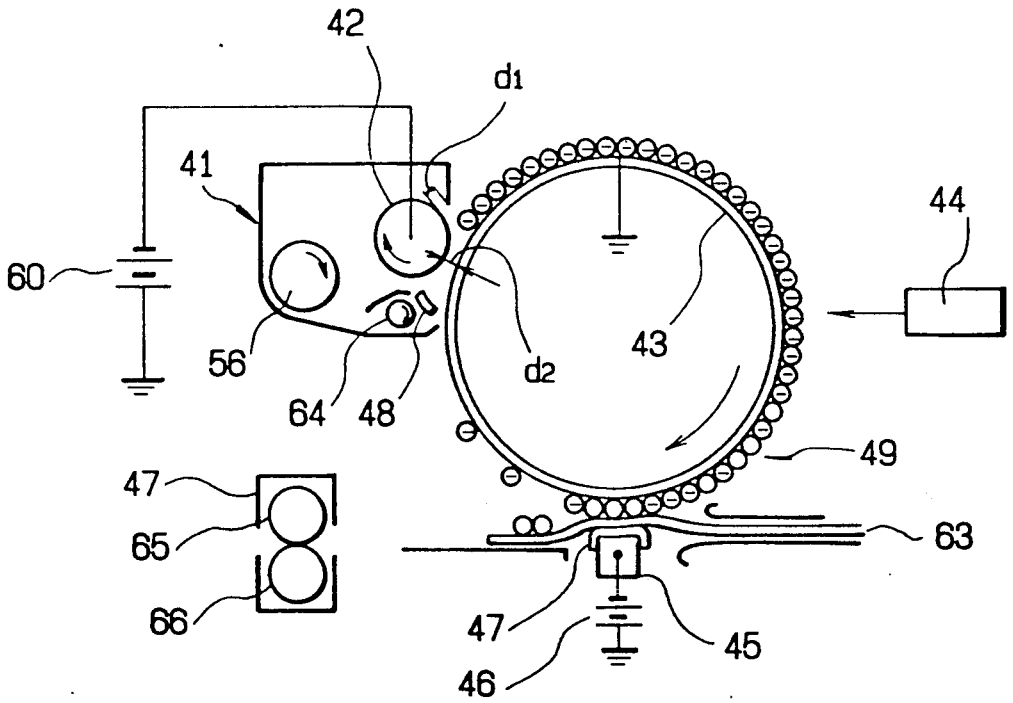
FIG. 4 is a schematic illustration explaining the image-forming process according to a preferred embodiment of the present invention.

A typical example of such an electrophotographic image-forming system is shown in FIG. 4. Referring to FIG. 4, a developing device 41 for uniformly forming a thin layer of a photosensitive toner on a conductive drum 43 is provided at a left upper position with respect to the conductive drum 43 as viewed in FIG. 4. The developing device 41 includes a magnetic sleeve 42 and an agitating roller 56. A mixture of a ferrite carrier and the photosensitive toner is uniformly agitated by the agitating roller 56, and is fed to the magnetic sleeve 42 while a triboelectric charge is imparted to the photosensitive toner, whereby a magnetic brush of the mixture of the photosensitive toner and the carrier is formed on the magnetic sleeve 42. The magnetic brush formed on the magnetic sleeve 42 is rubbed on the conductive drum 43 to form the thin layer of the photosensitive toner on the conductive drum 43. In actually forming the thin layer, the conductive drum 43 is grounded, and a bias voltage is applied from a power source 60, which is grounded, to the magnetic sleeve 42. Accordingly, a developing bias is operated between the magnetic sleeve 42 and the conductive drum 43 to carry out bias development with the operation of the triboelectric charge possessed by the photosensitive toner.

The thin layer of the photosensitive toner formed on the conductive drum 43 as mentioned above is fed to an exposure region by the rotation of the conductive drum 43. Exposure means 44 having a light source using a semiconductor laser is provided on a right side of the conductive drum 43 as viewed in FIG. 4. A laser beam is irradiated from the exposure means 44 to the thin layer of the photosensitive toner according to image information. The photosensitive toner exposed is improved in its conductivity, and as a result, the charge possessed by the toner is dissipated through the drum 43.

Thereafter, the photosensitive toner is fed to a transfer device provided under the drum 43 as viewed in FIG. 4. The transfer device includes a transfer charger 45 of a corona discharge type. A sheet of paper 63 is fed to between the drum 43 and the transfer charger 45, and a charge generated by corona discharge is provided from a back surface of the paper 63, thereby transferring the photosensitive toner corresponding to the latent image onto the paper 63.

Thereafter, the paper 63 on which the photosensitive toner has been transferred is fed to a fuser 47, and is fixed by a heat roller 65 and a pressure roller 66 in the fuser 47. The remaining photosensitive toner not transferred but left on the conductive drum 43 is squeezed off from the drum 43 by a cleaning blade 48 provided under the magnetic sleeve 42 of the developing device 41, and is then fed to the agitating roller 56 by a feeding roller 64.

Figure 1:
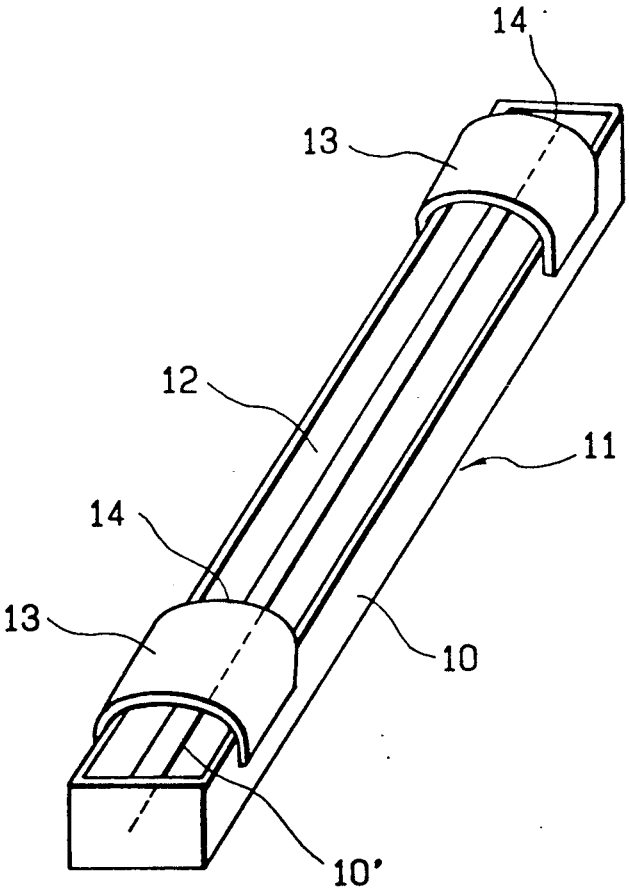
FIG. 1 is a schematic perspective view of the transfer device suitable for embodying the image-forming method of the present invention.
Figure 2:
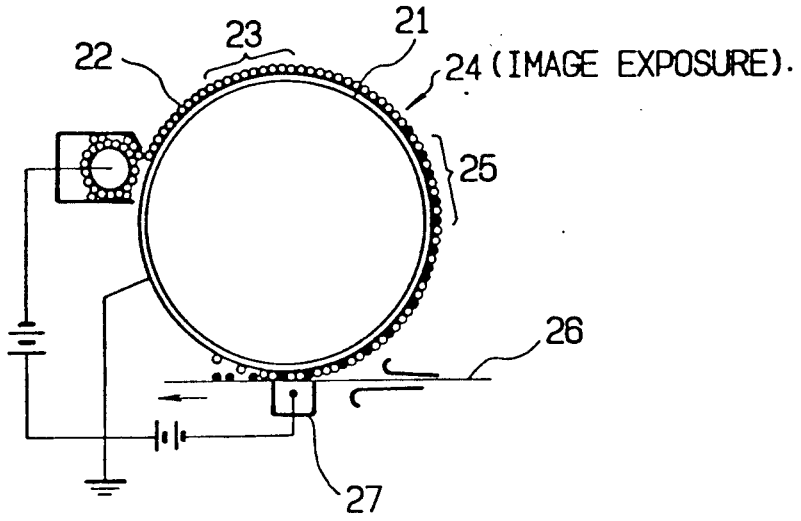
FIG. 2 PRIOR ART
FIG. 2 is a schematic illustration explaining the conventional image-forming method using a photosensitive toner.
Figure 3:
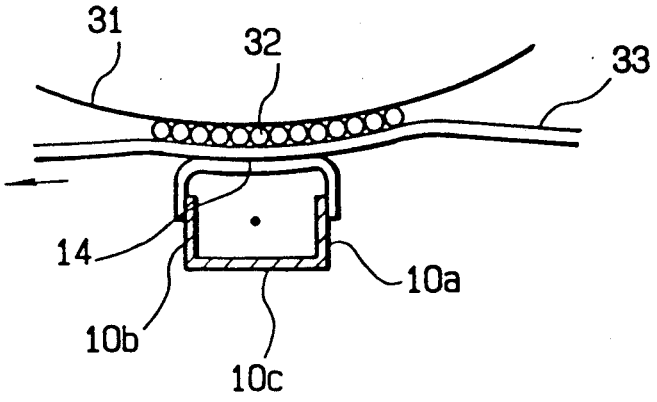
FIG. 3 is a schematic enlarged view showing the relational condition of the drum, toner layer, transfer material and presser member at the transfer region according to the present invention.

In such an image-forming device, the present invention improves the transfer charger 45 in order to well transfer the photosensitive toner. As shown in FIG. 1, reference numeral 11 designates a known transfer charger of a corona discharge type in itself. The transfer charger 11 is constructed of a sectional U-shaped shield case 10 (having opposed side walls **10*a* and 10*b* and a bottom wall 10*c* as shown in FIG. 3) and a charging wire 10' stretched in the shield case 10. A pair of presser members 13 for bringing a transfer material 33 into pressure contact with the thin layer of the photosensitive toner are fixedly mounted on the side walls 10*a* and 10*b* of the transfer charger 11 at an upper opening 12 thereof. That is, the presser members 13 are formed of an insulating film having an elasticity, and they are mounted at two positions so as to retain opposite side portions of the transfer material passing over the presser members 13 (i.e., at the opposite end portions of the transfer charger 11 at the upper opening 12). As shown in FIG. 3, in an actual transferring step, each presser member 13 is elastically deformed to form a downward recess 14 which presses the transfer material 33 against a peripheral surface 31 of the conductive drum through a toner thin layer 32 to thereby sufficiently bring the transfer material 33 into pressure contact with the toner thin layer 32, thus improving a transfer efficiency. The insulating film forming the presser members 13** is selected preferably from a material having a good slidability and mold-releaseability such as high-molecular polyethylene and polyester resin.

While the pressure of the presser members 13 to be applied to the transfer material 33 depends upon a kind of the toner to be used, a peripheral speed of the conductive drum, a size of the upper opening of the transfer charger, etc., it is adjusted to be preferably in the range of from 30 to 200 g/cm$^2$, more preferably in the range of from 55 to 110 g/cm$^2$. If the pressure is higher than this range, the toner corresponding to an non-image portion is unnecessarily transferred to cause the generation of fog. On the other hand, if the pressure is lower than this range, a desired effect of the present invention cannot be obtained.

Figure 6:
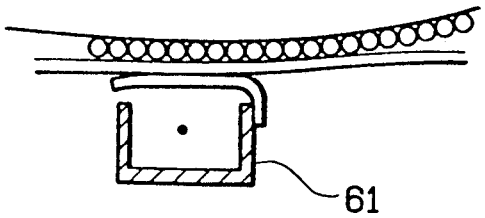
FIGS. 6A and 6B are schematic illustrations of different modifications of the presser member to be employed in the present invention.
Figure 6:
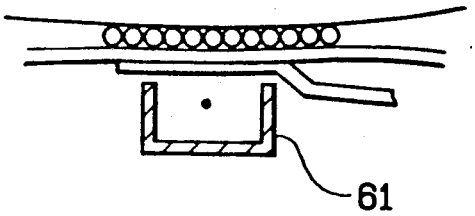

The construction of the presser members 13 may be modified as shown in FIGS. 6A and 6B.

In the modified construction as shown in FIG. 6A, the presser members 13 formed of an insulating film similar to that shown in FIG. 1 are fixed to one side wall 61 of the transfer charger at an upper opening thereof. As compared with the construction shown in FIG. 1 wherein the presser members 31 are fixed to the opposed side walls of the transfer charger, the pressure to be applied to the transfer material can be made lower even in the case where the material of the insulating film is the same.

In the modified construction as shown in FIG. 6B, the presser members 13 formed of an insulating film are not fixed to the transfer charger but are fixed directly to any body independent of the transfer charger, e.g., a base body of the image-forming device. In this case, it is particularly advantageous in maintenance that the charger may be easily taken out for the purpose of cleaning, for example.

In the image-forming method of the present invention, a voltage to be applied to the transfer charger is suitably set to 3.5–5.0 kV.

It is preferable that the presser members may be movable according to the size of the transfer material. For example, the size of the transfer material is detected, and the presser members are slid on the transfer charger to the positions so as to press the opposite side portions of the transfer material according to the detected size of the transfer material.

The photosensitive toner to be used in the present invention may be a known photosensitive toner in itself. For example, it may be selected from particles of composition formed by dispersing a photoconductive pigment in an electrical insulating resin medium. Examples of the photoconductive pigment may include an inorganic photoconductor such as zinc oxide and cadmium sulfide, and a photoconductive organic pigment such as perylene pigment, quinacridon pigment, pyranthrone pigment, phthalocyanine pigment, disazo pigment and trisazo pigment. The photoconductive pigment may be used in a proportion of preferably 3 to 600 parts by weight, more preferably 5 to 500 parts by weight versus 100 parts by weight of the fixing resin medium.

The fixing resin medium may be selected from a known electrical insulating resin and a photoconductive resin such as polystyrene, styrene-acrylic copolymer, acrylic resin, polycarbonate; polyallylate, polyester and polyvinylcarbazole. Such a photoconductive resin may be used solely or in combination with the electrical insulating resin. Further, a known dye sensitizer or chemical sensitizer may be compounded in the fixing resin, so as to provide a sensitivity to a monochromatic light having a given wavelength range. In addition to the above essential components, a known auxiliary such as an offset prevention agent and a pressure fixation promoting agent such as wax can be used.

It is desired that the particle size of the toner in median on the basis of a volume is preferably in the range of 6 to 12 μm, more preferably 8 to 10 μm. Further, it is also desirable that a standard deviation ($\sigma$) of distribution of the particle size on the basis of a volume is preferably 3.33 μm or less, more preferably 2.24 μm or less. If the particle size of the toner is larger than the above range, a charging quantity per unit weight is small. As a result, a contrast between an image portion and a non-image portion is reduced, and the toner corresponding to the non-image portion tends to be deposited onto the transfer material by the pressure applied at the transfer region. On the other hand, if the particle size of the toner is smaller than the above range, a light decay speed per particle of the toner is large, but it is difficult to obtain a desirable thickness of the toner thin layer. Further, if the standard deviation ($\sigma$) of the particle size distribution is larger than the above range, the close contact between the transfer material and the toner thin layer becomes insufficient because a small-size particle portion and a large-size particle portion are present in the toner thin layer. As a result, a reduction in density and the fogging tend to occur.

Figure 5:
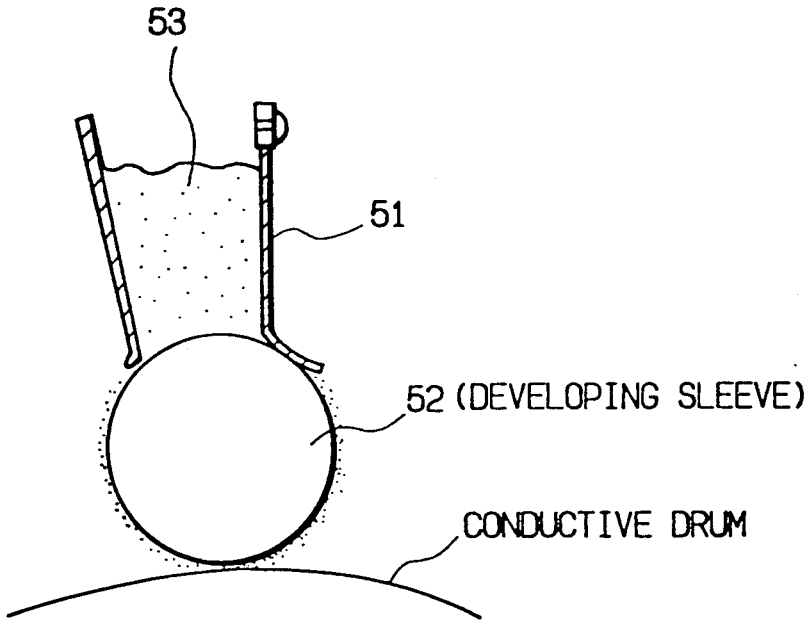
FIG. 5 is a schematic illustration of a preferred embodiment of the toner supply device to be employed in the present invention.

In the present invention, it is desired that the thickness of the toner thin layer is preferably in the range of 6 to 30 μm, more preferably 10 to 25 μm. Accordingly, considering the above-mentioned range of the particle size of the toner, the number of the toner thin layer is preferably in the range of 1.5 to 2.5. In the above preferred embodiment as described with reference to FIG. 4, the toner thin layer is formed by forming a magnetic brush from the toner and a developer carrier such as ferrite which is generally used in this field, and rubbing the conductive drum with the magnetic brush. In another preferred embodiment, the toner may be supplied onto the conductive drum by a so-called non-magnetic monocomponent developing device as shown in FIG. 5 wherein an elastic metal blade 51 is pressed against a developing sleeve 52 so as to supply a toner 53.

It is desired that the charging quantity of the toner for forming the thin layer is preferably in the range of ±5 to ±25 μC/g, more preferably in the range of ±8 to ±10 μC/g. In this range, the generation of fog can be prevented in the transfer region, and a high-density image can be obtained.

In the following, some examples of the present invention will be described. However, it is to be noted that the present invention should not be limited to these examples.

EXAMPLES 1 TO 4

In accordance with the following recipe, a photosensitive toner having an average particle size of 10 μm was obtained.

| | |
|---|---|
| Zinc Oxide (Hakusui Kagaku Grade #2) | 300 parts by weight |
| Styrene-Acrylic Resin (Mitsui Toatsu PA525) | 100 parts by weight |
| Cyanine Pigment (Nippon Kanko Shikiso NK1414) | 0.3 parts by weight |
| Black Perylene Pigment (BASF L0086) | 5 parts by weight |

The photosensitive toner obtained above was mixed with a ferrite carrier in the ratio of 5:95 to prepare a developer. The developer prepared above was applied to the image-forming device shown in FIG. 4 to carry out image formation.

The development was conducted under the following conditions of; a brush cutting clearance (d1) of 0.9 mm, a drum-sleeve distance (d2) of 1.15 mm, a drum peripheral speed of 90 mm/sec, and a toner charging quantity of −9 μC/g. Under the above development conditions, a bias voltage of −300 V having the same polarity as that of the charge of the toner was applied to the magnetic sleeve 42 to form a toner thin layer constituted of two layers on the conductive drum 43.

Then, the toner thin layer deposited on the conductive drum 43 was exposed by the semiconductor laser 44 according to image information to form an electrostatic latent image 49 which was in turn fed to the transfer device.

In the transfer device, a voltage (−4.7 kV) having the same polarity as that of the charge of the toner was applied to the corona charger 45 by the power source 46. Accordingly, a back surface of a sheet of paper as the transfer material was negatively charged to form an electric field between the drum and the paper. As the photosensitive toner exposed is reduced in electric resistance, a positive charge is injected into the toner by the electric field. As a result, the toner having the positive charge was transferred onto the paper.

The insulating films as the presser members 13 as shown in FIG. 1 were previously mounted at the upper opening of the transfer charger, so as to improve the close contact of the paper as the transfer material with the toner thin layer.

In the transferring step, the pressure of the films 13 to be applied to the drum surface was variously adjusted to 30, 55, 110 and 200 g/cm$^2$ by using four kinds of polyethylene terephthalate films having different thicknesses with the same size as follows:

| Applied Pressure (g/cm$^2$) | Film Thickness (μm) |
|---|---|
| 33 | 100 (Example 1) |
| 55 | 130 (Example 2) |
| 110 | 170 (Example 3) |
| 200 | 220 (Example 4) |

After the transferring step, the transfer material was fed to the fuser 47 to fix the toner image. On the other hand, the remaining toner not transferred was recovered into the developing device by the cleaning blade 48 provided therein.

COMPARATIVE EXAMPLE

The image formation was carried out under the same conditions as those in Example 1, provided that the insulating films were not provided (i.e., no pressure was applied to the drum).

EVALUATION

Figure 7:
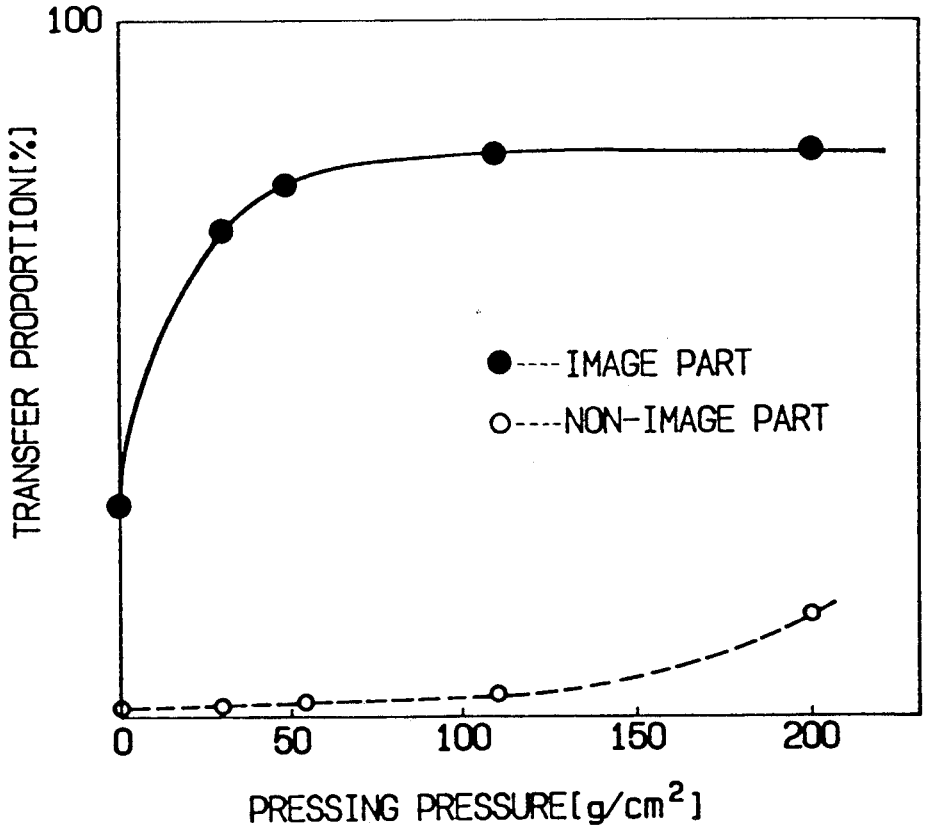
FIG. 7 is a graph showing the transfer rate at the image portion and the non-image portion according to the preferred embodiment of the present invention.

A transfer rate at the image portion and the non-image portion according to Examples 1 to 4 and Comparison was evaluated to obtain the result shown in FIG. 7. As apparent from FIG. 7, the transfer rate at the image portion according to Examples 1 to 4 wherein the pressure was applied is remarkably improved. Further, the toner images obtained according to Examples 1 to 4 using the insulating films were satisfactory with no void. To the contrary, the toner image obtained according to Comparison using no insulating film was unsatisfactory such that an image density was low and a void was present.

The density and the quality (void) of the images obtained according to Examples 1 to 4 and Comparative Example are shown in Table 1.

TABLE 1

| | Applied Pressure (g/cm$^2$) | Image Density | Non-image Density | Void |
|---|---|---|---|---|
| Example 1 | 33 | 0.86 | 0.009 | None |

TABLE 1-continued

| | Applied Pressure (g/cm$^2$) | Image Density | Non-image Density | Void |
|---|---|---|---|---|
| Example 2 | 55 | 0.90 | 0.012 | None |
| Example 3 | 110 | 0.90 | 0.015 | None |
| Example 4 | 200 | 0.96 | 0.016 | None |
| Comparative Example | 0 | 0.36 | 0.008 | Observed |

As apparent from the foregoing description, the image-forming method of the present invention using a photosensitive toner employs the presser members for bringing the transfer material into pressure contact with the toner thin layer at the opening portion of the corona charger (i.e., at an actually transferring region). Therefore, a transfer efficiency of the toner to the transfer material can be improved to thereby obtain a satisfactory image having a high density and no void.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What we claim is:

1. An electrophotographic image-forming method comprising the steps of:

(a) forming a thin layer comprising photosensitive toner charged to have a given polarity on a conductive drum, (b) exposing said photosensitive toner thin layer to light according to image formation, (c) transferring a part of said photosensitive toner thin layer onto a transfer material, said transfer material being contacted with said photosensitive toner thin layer exposed to light in said step (b) while applying a pressure of 30 to 200 g/cm$^2$ to a non-image bearing end portion of said transfer material by means of a pressure member, and (d) irradiating corona ion from a back side of said transfer material to said photosensitive toner thin layer by using a corona charger.

2. An electrophotographic image-forming method according to claim 1, wherein the pressure member is capable of moving in accordance with the size of the transfer material.

3. An electrophotographic image-forming method according to claim 1, wherein the pressure member comprises an insulating film.

* * * * *